US012774550B2

(12) United States Patent
Kim et al.

(10) Patent No.: US 12,774,550 B2
(45) Date of Patent: Oct. 27, 2026

(54) WASHING MACHINE AND CONTROL METHOD THEREOF

(71) Applicant: SAMSUNG ELECTRONICS CO., LTD., Suwon-si (KR)

(72) Inventors: Doyeon Kim, Suwon-si (KR); Jaeik Park, Suwon-si (KR); Sejun Lee, Suwon-si (KR); Hyungjin Choe, Suwon-si (KR); Jeonghoon Kang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 105 days.

(21) Appl. No.: 19/003,619

(22) Filed: Dec. 27, 2024

(65) Prior Publication Data

US 2026/0117446 A1 Apr. 30, 2026

Related U.S. Application Data

(63) Continuation of application No. PCT/KR2023/008403, filed on Jun. 16, 2023.

(30) Foreign Application Priority Data

Aug. 1, 2022 (KR) ..... 10-2022-0095480

(51) Int. Cl.

| | |
|---|---|
| ***D06F 37/22*** | (2006.01) |
| ***D06F 33/48*** | (2020.01) |
| *D06F 105/48* | (2020.01) |

(52) U.S. Cl.

CPC ..... *D06F 37/22* (2013.01); *D06F 33/48* (2020.02); *D06F 2105/48* (2020.02)

(58) Field of Classification Search

CPC ..... D06F 37/22

See application file for complete search history.

(56) References Cited

U.S. PATENT DOCUMENTS

| | | |
|---|---|---|
| 11,098,431 B2 | 8/2021 | Bae |
| 11,427,946 B2 | 8/2022 | Choi et al. |

FOREIGN PATENT DOCUMENTS

| | | |
|---|---|---|
| JP | 2005-291284 | 10/2005 |
| JP | 2015-042247 | 3/2015 |

(Continued)

OTHER PUBLICATIONS

International Search Report issued on Oct. 17, 2023 for International Application No. PCT/KR/2023/008403.

(Continued)

*Primary Examiner* — Jason Y Ko

(74) *Attorney, Agent, or Firm* — STAAS & HALSEY LLP

(57) ABSTRACT

A washing machine including a cabinet; a tub arrangeable inside the cabinet; a drum rotatable inside the tub; a motor configured to generate power to rotate the drum; a ball balancer arrangeable in the drum; a damper to support the tub and configured to have a damping force that is changeable; and at least one processor that controls the rotation speed of the motor and the damper force of the damper. As the drum is rotated by the motor according to the rotation speed of the motor controlled by the at least one processor, the at least one processor performs balancing of the ball balancer by controlling the damper force of the damper such that the damper has a smaller damper force in a last resonance section than that in a previous resonance section from among the plurality of resonance sections.

15 Claims, 24 Drawing Sheets

(56) References Cited

FOREIGN PATENT DOCUMENTS

| | | |
|---|---|---|
| JP | 2015-150378 | 8/2015 |
| JP | 2016-123860 | 7/2016 |
| JP | 2016-198248 | 12/2016 |
| JP | 6507367 | 5/2019 |
| KR | 10-0696952 | 3/2007 |
| KR | 10-2011-0015777 | 2/2011 |
| KR | 10-2011-0137718 | 12/2011 |
| KR | 10-1192155 | 10/2012 |
| KR | 10-1258341 | 4/2013 |
| KR | 10-1288674 | 7/2013 |
| KR | 10-1604690 | 3/2016 |
| KR | 10-2016-0058079 | 5/2016 |
| KR | 10-2017-0135251 | 12/2017 |
| KR | 10-2018-0029333 | 3/2018 |
| KR | 10-1940529 | 1/2019 |
| KR | 10-2325965 | 11/2021 |

OTHER PUBLICATIONS

Written Opinion issued on Oct. 17, 2023 for International Application No. PCT/KR/2023/008403.

WASHING MACHINE AND CONTROL METHOD THEREOF

CROSS-REFERENCE TO RELATED APPLICATION

This application is a continuation application is a continuation application, under 35 U.S.C. § 111(a), of international application No. PCT/KR2023/008403, filed Jun. 16, 2023, which claims priority under 35 U. S. C. § 119 to Korean Patent Application No. 10-2022-0095480, filed Aug. 1, 2022, the disclosures of which are incorporated herein by reference in their entireties.

TECHNICAL FIELD

The present disclosure relates to a washing machine and a control method thereof, and more particularly, to a washing machine for changing a damping force of a damper and a control method thereof.

BACKGROUND ART

A washing machine is an apparatus that removes contamination from laundry by the surface activity of water streams and detergent by including an outer tank (hereinafter, referred to as a "tub") for storing water (rinsing water), a washing and dehydrating tank (hereinafter, referred to as a "drum") rotatably installed inside the tub and accommodating laundry, a pulsator rotatably installed inside the drum to generate water streams, and a motor that generates a driving force for rotating the drum and pulsator.

The washing machine performs washing through a series of operations including a washing cycle of separating dirt from laundry with water (specifically, washing water) containing a detergent, a rinsing cycle of rinsing bubbles of laundry or remaining detergent with water (specifically, rinsing water) containing no detergent, and a dehydrating cycle of removing water of laundry through high-speed rotations.

While washing is performed by such a series of operations, the drum may rotate in an unbalance state in which laundry is not evenly distributed within the drum. In this case, a biased force is applied to the rotating axis of the drum to cause the drum to move eccentrically, resulting in vibration of the tub. The vibration of the tub becomes more severe when the drum rotates at a high speed for a dehydrating cycle, and generates loud vibration and noise.

Accordingly, a washing machine equipped with a ball balancer capable of stabilizing the rotation of the drum by offsetting the unbalanced load caused by the unbalance of laundry has been proposed. The ball balancer prevents the application of an unbalanced force to the rotating axis by moving the balls inside the drum while the drum rotates.

However, in the washing machine equipped with the ball balancer, when the clumping of the balls and the unbalance of the laundry are in the same phase (same position), the vibration of the tub becomes more severe in a resonance range (initial dehydrating) when a dehydrating cycle begins, which causes the tub to hit the frame of the washing machine. In this case, the entire washing machine will vibrate abnormally, resulting in a dehydrating failure which makes it impossible to perform the dehydrating cycle.

Meanwhile, the washing machine includes a damper that supports the tub and attenuates vibration generated in the tub. Recently, dampers including magnetorheological elastomer are used. The magnetorheological elastomer changes the stiffness in response to a magnetic field, and accordingly, the frictional force of the damper changes to control the damping force. For example, it is possible to increase the damping force in a low-speed vibration section and decrease the damping force in a high-speed vibration section.

DISCLOSURE

Technical Problem

An aspect of the disclosure provides a washing machine capable of reducing vibration and noise by rotating a drum in a resonance section and reducing a frictional force of a damper to increase a whirling motion of the drum such that balls of a ball balancer are positioned in an opposite side of weight eccentricity by laundry, and a control method of the washing machine.

Another aspect of the disclosure provides a washing machine including a damper with reduced manufacturing time and low manufacturing cost.

Another aspect of the disclosure provides a washing machine including a damper with improved durability by firmly coupling a piston and a header.

Technical Solution

A washing machine according to an embodiment may include a cabinet, a tub arrangeable inside the cabinet, a drum rotatable inside the tub, a motor configured to generate power to rotate the drum, a ball balancer arrangeable in the drum, a damper to support the tub and configured to have a damper force that is changeable, and at least one processor configured to control a rotation speed of the motor and the damper force of the damper. As the drum is rotated by the motor according to the rotation speed of the motor controlled by the at least one processor, the at least one processor may be configured to perform balancing of the ball balancer by controlling the damper force of the damper such that a damping force in a final resonance section among a plurality of resonance sections that occur is smaller than a damper force in a previous resonance section among the plurality of resonance sections.

The at least one processor may be configured to increase a rotation speed of the motor such that the drum passes the previous resonance section, control the motor to rotate at a second rotation speed that is higher than a first rotation speed in the previous resonance section for a preset time, and decrease a rotation speed of the motor according to elapse of the preset time such that the drum passes the final resonance section.

The at least one processor may be configured to perform balancing of the ball balancer based on a position and a weight of laundry.

The at least one processor may be configured to perform the balancing such that balls inside the ball balancer move to an opposite side of eccentricity according to the position and the weight of the laundry.

The at least one processor may be configured to perform a dehydrating cycle by driving the motor at a maximum rotation speed after the balancing of the ball balancer.

The resonance section may be a speed section of the motor in which excessive vibration of the tub occurs during a dehydrating cycle.

The ball balancer may be arranged in at least one of a front side or a rear side of the drum.

The damper may include a housing extending between the cabinet and the tub, a piston configured to move inside the housing, the piston including an inside that is hollow that extends along an extension direction of the housing, and a header coupled to an end of the piston.

The piston may be formed to include the hollow by drawing a steel material, the hollow may include an inlet cut to correspond to a shape of the header such that the header is insertable in the inlet, and the header while inserted in the inlet may be pressed by a roller and fixed to the piston.

The piston may be formed to include the hollow by drawing a steel material, the header may include a screw portion inserted in the hollow, and the hollow may include a screw groove portion formed by rotating the screw portion and corresponding to the screw portion.

The washing machine may include a bobbin surrounding an outer circumferential surface of the piston inside the housing, wherein a coil is wound around the bobbin, a yoke arrangeable along the extension direction of the housing with respect to the bobbin and configured to form a magnetic field while current flows through the coil wound around the bobbin, and a friction member arrangeable between the piston and the yoke and including a Magneto-Rheological Fluid of which viscosity changes by a magnetic field.

A control method of a washing machine including a cabinet, a tub arrangeable inside the cabinet. The control method according to an embodiment, may include rotating a motor configured to rotate a drum rotatable inside the tub of the washing machine such that a plurality of resonance sections occur, and performing balancing of a ball balancer by controlling a damper force of a damper such that a damping force in a final resonance section among a plurality of resonance sections that occur is smaller than a damping force in a previous resonance section among the plurality of resonance sections.

The rotating of the motor may include gradually increasing a rotation speed of the motor such that the drum passes the previous resonance section, controlling the motor to rotate at a second rotation speed that is higher than a first rotation speed in the previous resonance section, for a preset time, and decreasing a rotation speed of the motor according to elapse of the preset time such that the drum passes the final resonance section.

The performing of the balancing may include performing balancing of the ball balancer based on a position and weight of laundry.

The performing of the balancing may include performing balancing such that balls inside the ball balancer move to an opposite side of eccentricity according to the position and weight of the laundry.

The control method may further include driving the motor at a maximum rotation speed after the balancing of the ball balancer to perform a dehydrating cycle.

The resonance section may be a speed section of the motor in which excessive vibration of the tub occurs during the dehydrating cycle.

Advantageous Effects

According to an aspect of the disclosure, by rotating, while a dehydrating cycle is performed, a drum in a resonance section and reducing a frictional force of a damper to increase a whirling motion of the drum such that balls of a ball balancer are positioned in an opposite side of weight eccentricity by laundry, vibration and noise of a washing machine may be reduced.

According to another aspect of the disclosure, a washing machine including a damper with reduced manufacturing time and low manufacturing cost through an efficient process may be provided.

Another aspect of the disclosure, a washing machine including a damper with improved durability by firmly coupling a piston and a header through an efficient process may be provided.

MODES OF THE INVENTION

Figure 1:
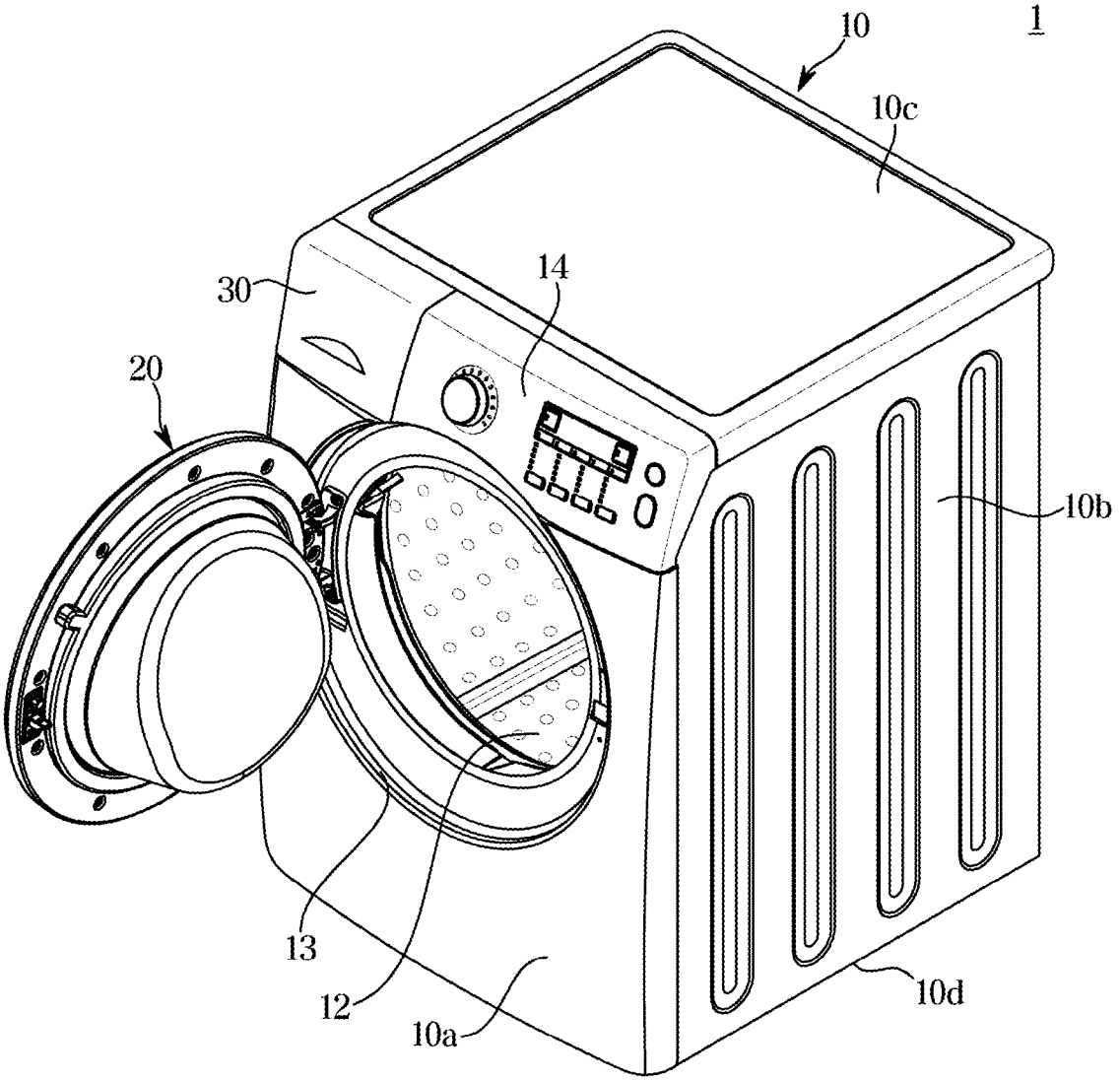
FIG. 1 is a perspective view showing a washing machine according to an embodiment of the present disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are merely used to describe the embodiments, and are not intended to limit and/or restrict the disclosure. An expression used in the singular encompasses the expression of the plural, unless it has a clearly different meaning in the context. In the present specification, it is to be understood that the terms such as "comprising", "including" or "having", etc., are intended to indicate the existence of the features, numbers, steps, operations, components, parts, or combinations thereof disclosed in the specification, and are not intended to preclude the possibility that one or more other features, numbers, steps, operations, components, parts, or combinations thereof may exist or may be added.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Meanwhile, in the following description, the terms "front", "upper", "lower", "left", "right", etc. are defined based on the drawings, and the shapes and positions of the components are not limited by the terms.

Hereinafter, an embodiment of the disclosure will be described in detail with reference to the accompanying drawings.

Figure 2:
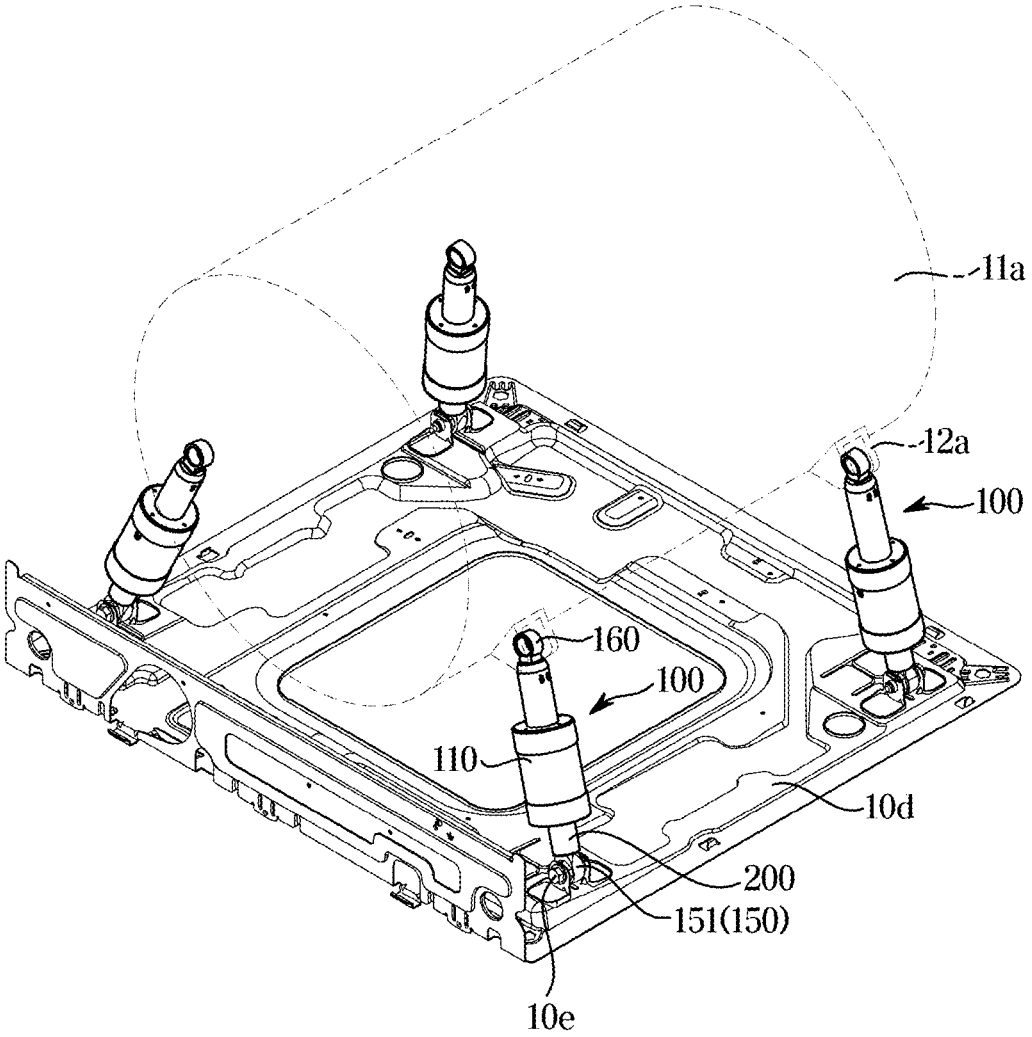
FIG. 2 is a perspective view showing some components of the washing machine shown in FIG. 1 according to an embodiment of the present disclosure.

FIG. 1 is a perspective view showing a washing machine according to an embodiment of the present disclosure. FIG. 2 is a perspective view showing some components of the washing machine shown in FIG. 1.

Referring to FIG. 1, a washing machine 1 may include a cabinet 10 forming an appearance, a tub 11 installed inside the cabinet 10 to store water, and a cylindrical drum 12 rotatably installed inside the tub 11 and having a plurality of dehydrating holes formed in the wall.

The cabinet 10 may be provided in a substantially hexahedral shape. The cabinet 10 may include a front plate 10*a*, a rear plate (not shown), both side plates 10*b*, a top plate 10*c*, and a bottom plate 10*d* forming a bottom. The front plate 10*a* of the cabinet 10 may be a front panel 10*a*.

An embodiment of the present disclosure shows an example in which the front plate 10*a*, the rear plate (not shown), the both side plates 10*b*, the top plate 10*c*, the bottom plate 10*d*, etc. forming the cabinet 10 are prepared separately and then assembled together. However, the present disclosure is not limited thereto. For example, at least some of the front plate 10*a*, the rear plate (not shown), the both side plates 10*b*, the top plate 10*c*, or the bottom plate 10*d* of the cabinet may be integrated into one body.

In the front plate 10*a* of the cabinet 10, an opening 13 through which laundry is put in or taken out may be formed. The tub 11 and the drum 12 may also have openings through which laundry is put in or taken out in a front direction of the cabinet 10, and the openings of the tub 11 and the drum 12 may be positioned to correspond to the opening 13 of the front plate 10*a*.

In the opening 13 of the cabinet 10, a door 20 for opening or closing the openings of the tub 11 and the drum 12 may be mounted.

A control panel 14 for controlling operations of the washing machine 1 may be provided on an upper portion of the front plate 10*a* of the cabinet 10. The control panel 14 may be a component included in the front panel 10*a*.

A driving device (not shown) may be provided behind the drum 12. The driving device may be a component for rotating the drum 12 and transfer a driving force generated in a motor to a rotating shaft to rotate the drum 12.

A water supply valve (not shown) for controlling supply of water and water supply pipes may be provided above the tub 11. Also, a detergent supply device 30 for supplying a detergent to inside of the tub 11 while water is supplied may be installed above the tub 11.

A drain device (not shown) including a drain pipe (not shown), a drain valve (not shown), etc. for draining water stored in the tub 11 may be installed below the tub 11.

Referring to FIG. 2, the tub 11 (11*a*) may be elastically supported from the cabinet 10 by springs (not shown) provided in an upper portion of the tub 11 and dampers 100 provided in a lower portion of the tub 11. For example, the springs (not shown) and the dampers 100 may absorb vibration energy between the tub 11 and the cabinet 10 upon transferring of vibration generated according to a rotation of the drum 12 to the tub 11 and the cabinet 10 to attenuate vibration to be transferred to the cabinet 10.

A plurality of dampers 100 may be provided to support the lower portion of the tub 11. For example, four dampers 100 may be provided to support the tub 11. The plurality of dampers 100 may reduce shaking or vibration that is transferred from the tub 11 to the cabinet 10 during a washing, rinsing, or dehydrating process.

Each damper 100 may include a first fixing portion 150 formed at a lower end and a second fixing portion 160 formed at an upper end. The damper 100 may include the first fixing portion 150 positioned adjacent to the cabinet 10 and the second fixing portion 160 positioned adjacent to the tub 11.

On the bottom plate 10*d* of the cabinet 10, a first damper coupling portion 10*e* coupled to the lower end of the damper 100 may be provided. The first damper coupling portion 10*e* may correspond to the first fixing portion 150 of the damper 100. On an outer surface of the tub 11, a second damper coupling portion 12*b* coupled to the upper end of the damper 100 may be provided. The second damper coupling portion 12*b* may correspond to the second fixing portion 160 of the damper 100.

In the drawings, the first fixing portion 150 is shown to be provided at the lower end of the damper 100, and the second fixing portion 160 is shown to be provided at the upper end of the damper 100. However, the present disclosure is not limited thereto. For example, the first fixing portion 150 may be provided at the upper end of the damper 100, and the second fixing portion 160 may be provided at the lower end of the damper 100.

The damper 100 may include a housing 110. The housing 110 may extend between the cabinet 10 and the tub 11.

The damper 100 may include a piston 200 coupled to the first fixing portion 150. The piston 200 may be movable inside the housing 110 and extend along an extension direction of the housing 110.

The damper 100 may include a friction member 145 surrounding an outer circumferential surface of the piston 200. According to a motion of the piston 200, a frictional force may be generated between the piston 200 and the friction member 145. At this time, by changing the frictional force of the friction member 145, a damping force of the damper 100 may be controlled, which will be described in detail below.

Figure 3:
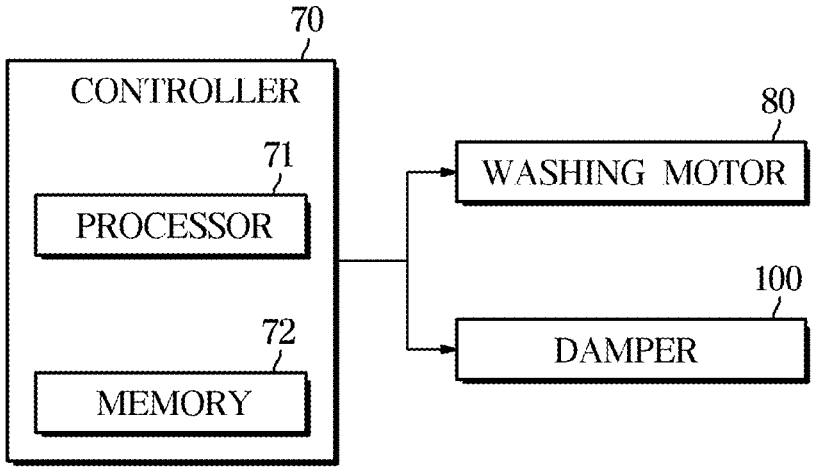
FIG. 3 is a control block diagram of a washing machine according to an embodiment.

FIG. 3 is a control block diagram of a washing machine according to an embodiment.

The washing machine according to an embodiment may include a controller 70, a motor 80, and a damper 100. The controller 70 may include a processor 71 and a memory 72.

The controller 70 may include the memory 72 that memorizes a control program and control data for controlling the motor and the damper, and the processor 71 that generates a control signal according to the control program and control data stored in the memory 72. The memory 72 and the processor 71 may be integrated into one body or provided separately.

The memory 72 may store a program, etc. for controlling the motor and the damper.

The memory 72 may include a volatile memory, such as Static Random Access Memory (S-RAM) or Dynamic Random Access Memory (D-RAM), for memorizing data temporarily. Also, the memory 72 may include a non-volatile memory, such as Read Only Memory (ROM), Erasable Programmable Read Only Memory (EPROM), or Electrically Erasable Programmable Read Only Memory (EEPROM), for storing data for a long time.

The processor 71 may include various logic circuitries and arithmetic circuitries, and the processor 71 may process data according to a program provided from the memory 71 and generate a control signal according to the processed result.

The controller 70 may control a rotation speed of the motor 80. By controlling a rotation of the motor 80, the controller 70 may also control a rotation speed of the drum 12.

The controller 70 may control a damping force of the damper 100. For example, the controller 70 may control a damping force by controlling a frictional force of the damper 100, which includes various embodiments for controlling a damping force of the damper 100.

The controller 70 may control a rotation speed of the motor 80 and a damping force of the damper 100, thereby performing balancing of a ball balancer 90, which will be described below.

Before details about balancing of the ball balancer 90 are described, an operation process of the washing machine 1 including the ball balancer 90 will be first described.

Figure 4:
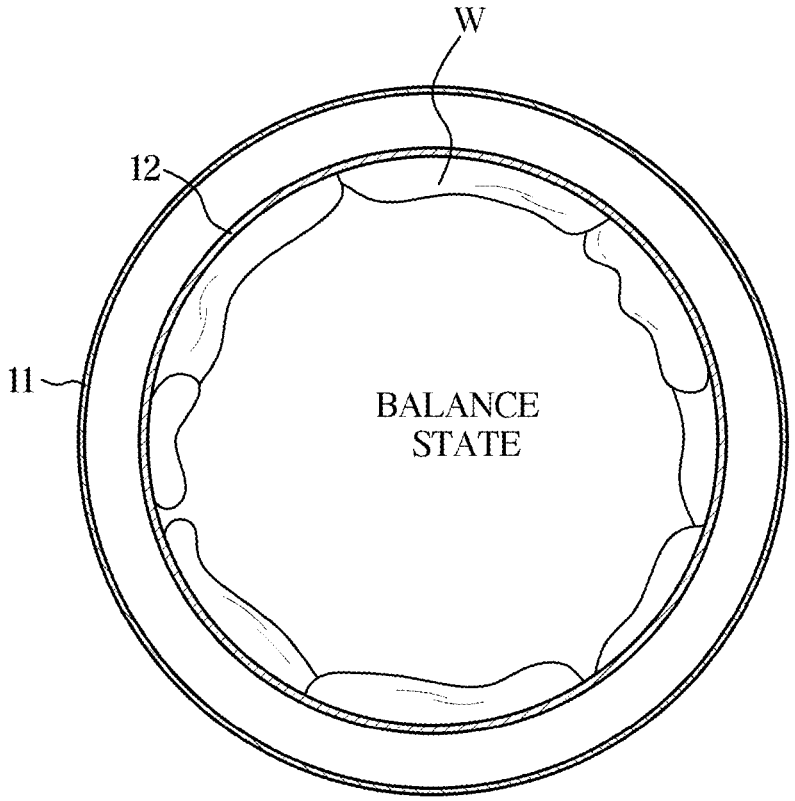
FIG. 4 shows a balance state of laundry inside a drum in a typical washing machine according to an embodiment of the present disclosure.
Figure 5:
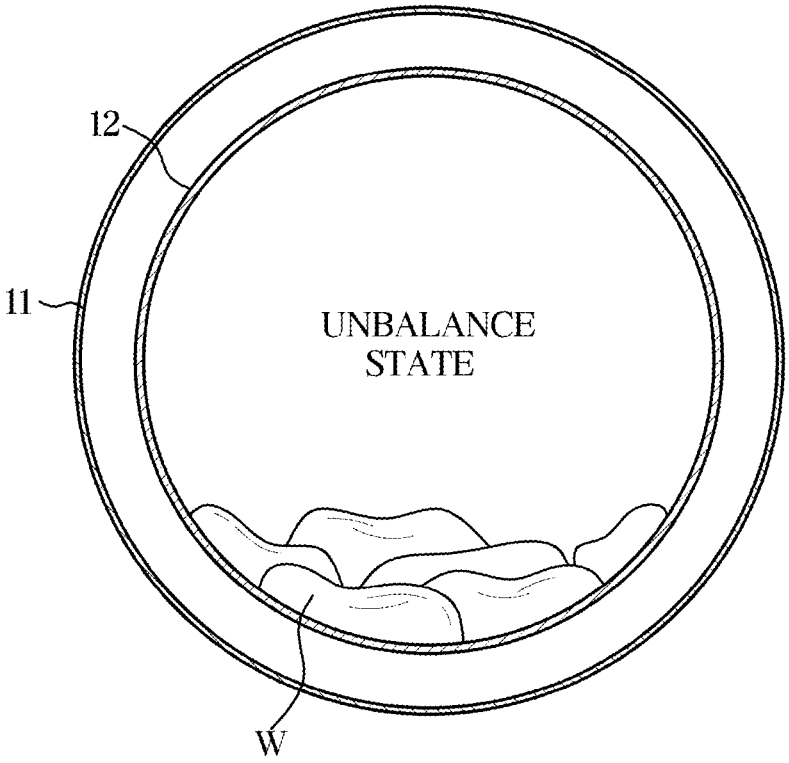
FIG. 5 shows an unbalance state of laundry inside a drum in a typical washing machine according to an embodiment of the present disclosure.

FIG. 4 shows a balance state of laundry inside a drum in a typical washing machine, and FIG. 5 shows an unbalance state of laundry inside a drum in a typical washing machine.

Generally, the washing machine 1 may be an apparatus that performs washing by utilizing flow of laundry W and water flow generated by driving the motor 80 and rotating the drum 12, and during a dehydrating cycle, the drum 12 may rotate at a high speed of 700 rpm to 1000 rpm, which generates vibration and noise. The vibration and noise generated during the dehydrating cycle may mainly depend on a distribution of laundry immediately before the dehydrating cycle.

In a balance state where laundry W is evenly distributed on an inner wall of the drum 12, as shown in FIG. 4, vibration and noise may be little generated in the tub 11 while the drum 12 rotates at a high speed for a dehydrating cycle.

However, in an unbalance state in which laundry W is not evenly distributed inside the drum 12, as shown in FIG. 5, while the drum 12 rotates at a high speed for a dehydrating cycle, an unbalanced load caused by the unbalance of the laundry W may apply an unbalanced force to the rotating axis of the drum 12 to cause the drum 12 to move eccentrically, and thus, large vibration may occur in the tub 11, thereby generating noise.

Accordingly, in an embodiment of the present disclosure, the ball balancer 90 capable of stabilizing a rotation of the drum 12 by offsetting an unbalanced load caused by unbalance of laundry W may be installed.

When an unbalanced load occurs by unbalance of laundry W while the drum 12 rotates, the ball balancer 90 may move balls 92 inside a balancer housing 91 in a circumferential direction of the drum 12 to a position that is symmetrical to a position where the unbalanced load occurs. At this time, because the balls 92 correspond to the unbalanced load, the balls 92 may suppress vibration of the tub 11 that may occur by the unbalanced load.

During a dehydrating cycle, there may be a high possibility that an unbalance phenomenon will occur because laundry W inside the drum 12 is wet. Therefore, in order to suppress vibration of the tub 11 at an initial stage of a dehydration cycle, the ball balancer 90 may need to quickly maintain balance of the drum 12 when the dehydration cycle begins.

When a dehydration rotation of the drum 12 begins according to driving of the motor 80, a rotation speed of the drum 12 may begin to increase. At an initial stage of a dehydrating cycle, a viscous oil 93 filled inside the ball balancer 90 may not push up the balls 92. Thus, the balls 92 inside the ball balancer 90 may collide with an inner wall of the balancer housing 91 and the balls 90 may also collide with each other and move. Therefore, a speed difference between a rotation speed of the drum 12 and a rotation speed of the balls 92 may be made. Due to the speed difference between the rotation speed of the drum 12 and the rotation speed of the balls 92, a resonance point may occur where the tub 11 vibrates excessively. In the case in which laundry W is unbalanced, the vibration of the tub 11 may become more severe before the balls 92 reach a balancing position (a position where the balls are placed at an opposite side of the laundry "W"). Accordingly, the balls 92 which need to suppress vibration at the initial stage of the dehydrating cycle may actually cause excessive vibration of the tub 11 together with the laundry W. This will be described with reference to FIGS. 6 and 7.

Figure 6:
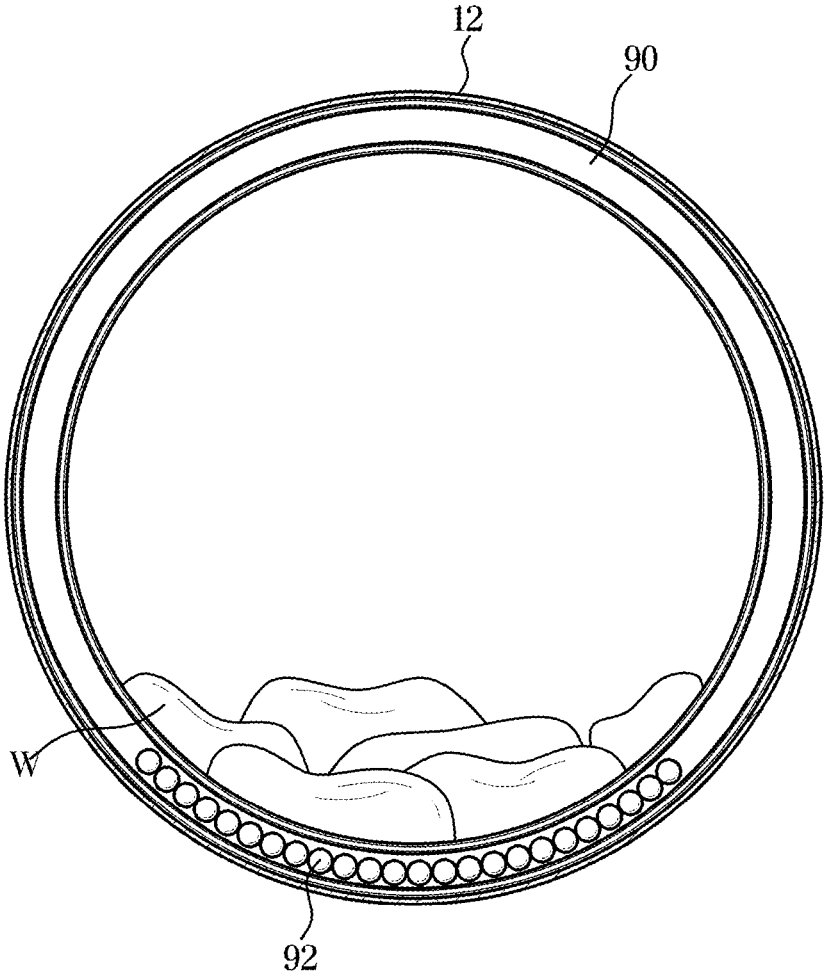
FIG. 6 shows a case in which balls and laundry are in the same phase in a washing machine including a ball balancer according to an embodiment of the present disclosure.
Figure 7:
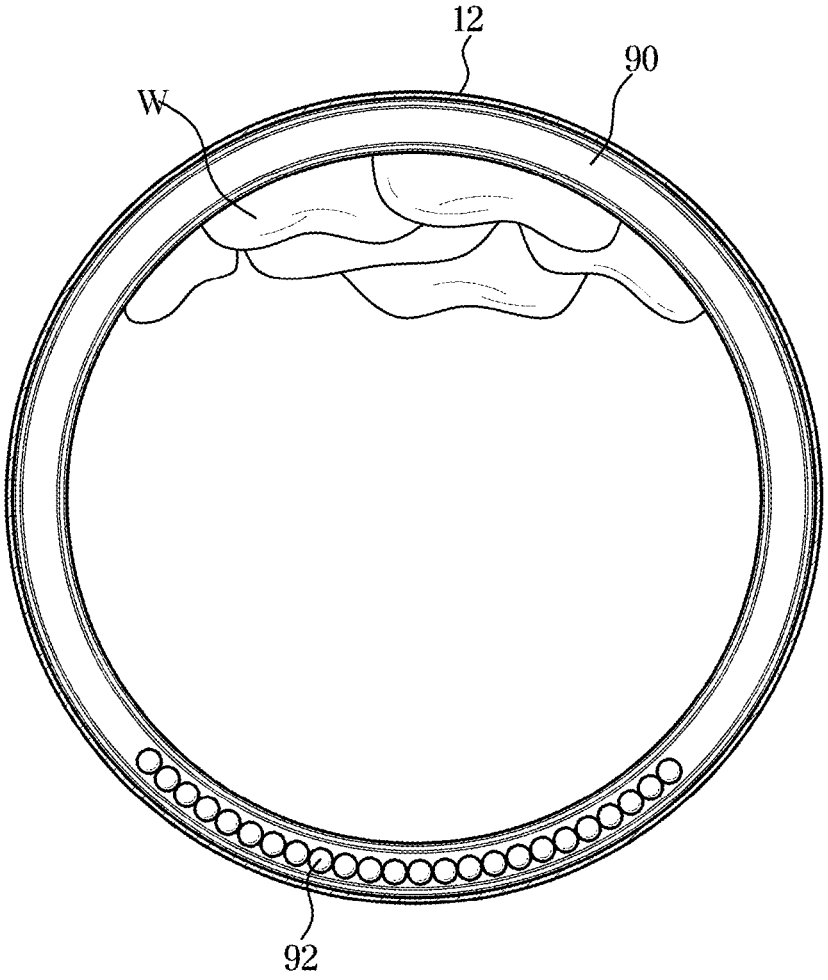
FIG. 7 shows a case in which balls and laundry are in opposite phases in a washing machine including a ball balancer according to an embodiment of the present disclosure.

FIG. 6 shows a case in which balls and laundry are in the same phase in a washing machine including a ball balancer according to an embodiment of the present disclosure, and FIG. 7 shows a case in which balls and laundry are in opposite phases in a washing machine including a ball balancer according to an embodiment of the present disclosure.

As shown in FIG. 6, while the balls 92 inside the ball balancer 90 and an unbalanced load generated by unbalance of laundry W are in the same phase (same position), a resonance point may occur at an initial stage of dehydration and a maximal vibration displacement of the tub 11 may be generated. In the case in which a gap between the tub 11 and a frame of the washing machine 1 is not sufficient, the tub 11 may hit the frame of the washing machine 1 and apply an impact to a main body 10, resulting in a dehydration failure which makes it impossible to perform the dehydrating cycle.

In contrast, as shown in FIG. 7, while the balls 92 inside the ball balancer 90 and an unbalanced load generated by unbalance of laundry W are in opposite phases (opposite positions), the unbalanced load may not be large even though a resonance point occurs at an initial stage of dehydration, and accordingly, a vibration displacement of the tub 11 may not be large.

Accordingly, in a dehydrating cycle where unbalance is likely to occur, balancing may need to be performed such that the balls 92 inside the ball balancer 90 move smoothly in an opposite direction of eccentricity according to a position and weight of laundry W before the drum 12 rotates at highest RPM.

Therefore, an embodiment of the disclosure may propose a dehydrating cycle controlled to rotate, before rotating the drum 12 at highest RPM, the drum around a resonance point and reduce a damping force of the damper to control the drum to perform a large whirling motion such that the balls 92 inside the ball balancer 90 move smoothly to an opposite side of eccentricity of laundry.

Figure 8:
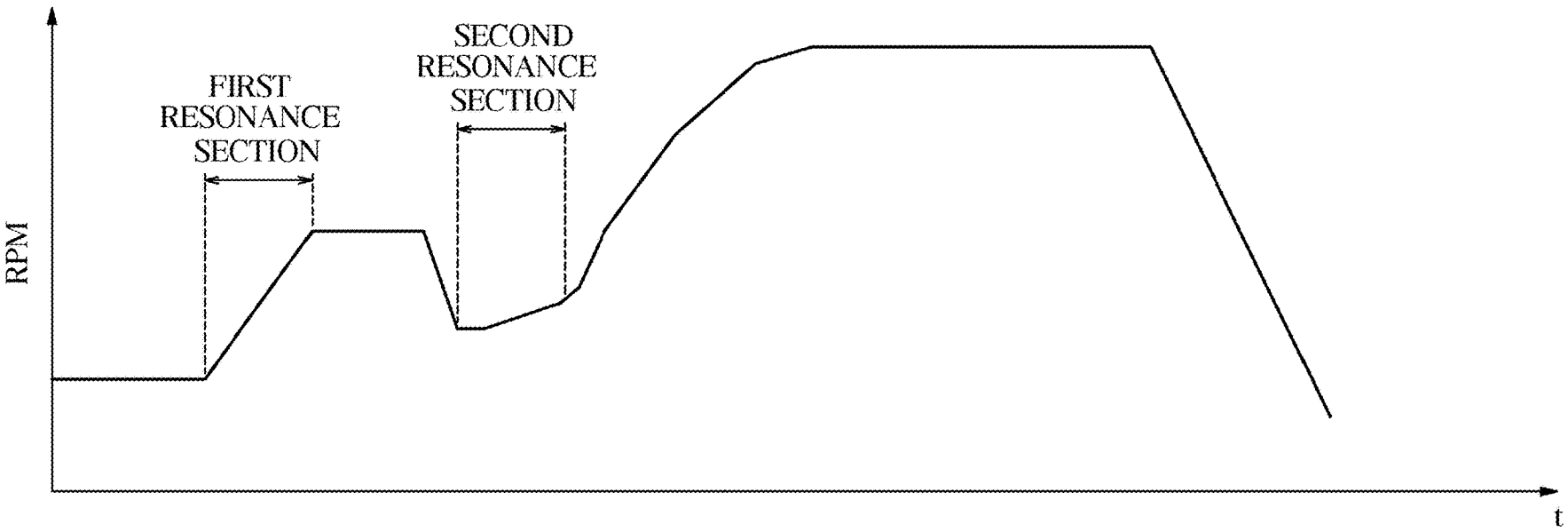
FIGS. 8 and 9 show changes in RPM of a drum and a frictional force of a damper over time, according to an embodiment.
Figure 9:
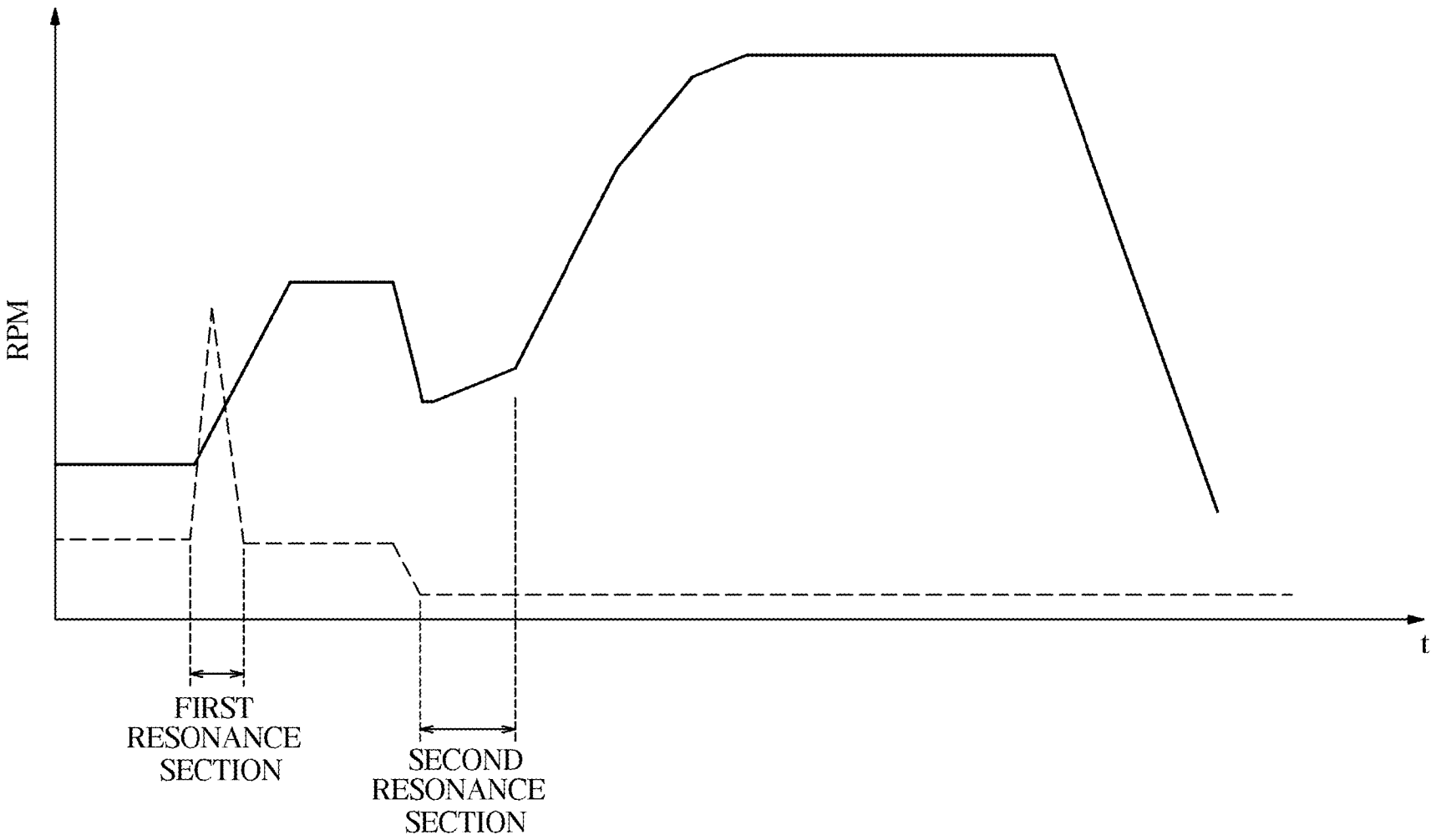
Figure 10:
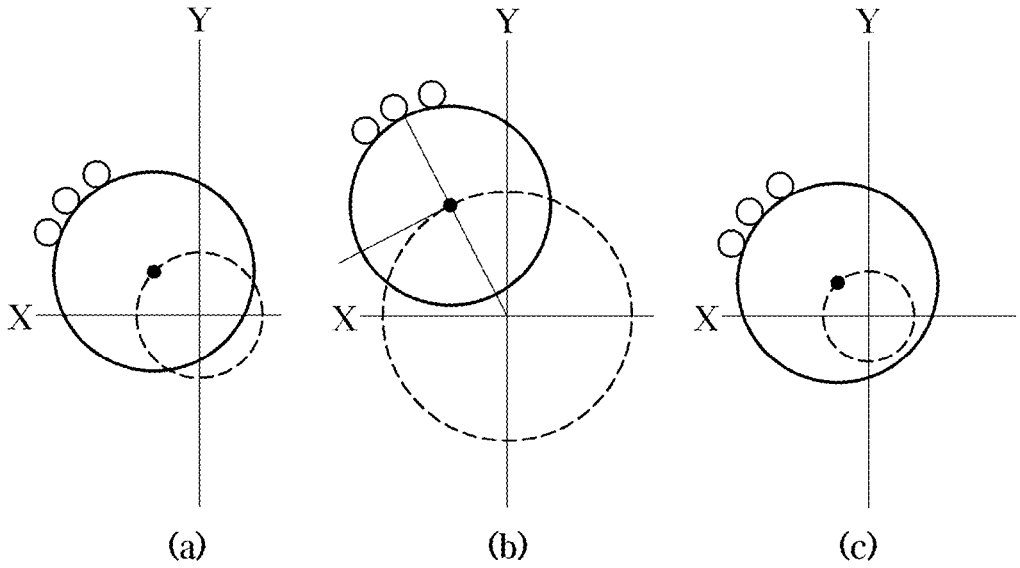
FIG. 10 shows a whirling motion of a drum according to an embodiment of the present disclosure.

FIGS. 8 and 9 show changes in RPM of a drum and a frictional force of a damper over time, according to an embodiment, and FIG. 10 shows a whirling motion of a drum.

Referring to FIG. 8, while the controller 70 controls the motor 80, a rotation speed of the drum 12 may change over time.

First, for a dehydrating cycle, the motor 80 may be controlled to gradually increase rpm of the drum 12.

At this time, as the rotation speed of the drum 12 increases, the rotation speed of the drum 12 may pass a resonance section which is a speed section of the motor 80 causing excessive vibration of the tub. A resonance section which the rotation speed of the drum 12 first passes is referred to as a first resonance section.

The resonance section may depend on a weight, etc. of the washing machine, and a resonance may occur while the drum rotates between about 150 RPM and about 240 RPM with a washing capacity of about 21 kg to about 25 kg. The first resonance section and a second resonance section which will be described below may mean sections between about 150 RPM and about 250 RPM.

While water is removed from laundry within the first resonance section, an unbalance of the laundry may occur due to materials of the laundry, etc.

Due to the unbalance, the balls inside the ball balancer may fail to move in an opposite direction of eccentricity of the laundry, which may make vibration and noise more severe, as described above with reference to FIG. 6. To prevent this, balancing may be performed to smoothly move the balls in the opposite direction of eccentricity of the laundry.

Accordingly, after the first resonance section, the rotation speed of the drum 12 may pass a second resonance section by rotating the motor 80 at a higher rotation speed than the rotation speed in the first resonance section for a preset time and again generating excessive vibration of the tub.

The first resonance section where an unbalance of laundry is detected is referred to as an unbalance detection section, and by detecting an unbalance of laundry in the unbalance detection section, following rebalancing may be performed.

That is, by rotating the motor 80 at a higher rotation speed than a rotation speed in the first resonance section for a preset time and then reducing the rotation speed, the rotation speed of the drum 12 may pass the second resonance section.

While the drum 12 rotates in the resonance section, a whirling motion of the drum 12 may increase, and accordingly, the balls may be rearranged and thus move smoothly in the opposite direction of eccentricity of the laundry.

The second resonance section where the balls are rearranged is also referred to as a rebalancing section, and in the rebalancing section, the balls may be rearranged to suppress noise and vibration according to the unbalance of the laundry.

The resonance sections are not limited to the first and second resonance sections described above, and three or more resonance sections may appear.

In this case, the rotation speed of the motor 80 that has passed the previous resonance section and rotated at the high rotation speed may be reduced to enter a final resonance section.

In addition, to increase a whirling motion of the drum 12, a damping force of the damper 100 may be controlled.

That is, by reducing a damping force of the damper 100 while the drum 12 enters the second resonance section, a whirling motion of the drum 12 may increase.

By controlling the rotation speed of the drum 12 and the damping force of the damper 100, a whirling motion of the drum 12 may increase, and accordingly, balancing may be performed such that the balls inside the ball balancer move smoothly in an opposite direction of eccentricity of laundry.

Referring to FIG. 10, it is seen that a whirling motion of the drum 12 occurs more significantly in (b) than in (a) and (c).

A control of setting a rotation speed of the drum 12 within a resonance section and further reducing a damping force of the damper 100 such that the drum 12 performs a whirling motion in the state of (b) may be possible.

According to the control, while a dehydrating cycle is performed by driving the motor 80 at a maximum rotation speed after the balancing of the balls, the balls may move smoothly in the opposite direction of eccentricity, and vibration and noise generated in the washing machine 1 may be reduced even while the rpm further increases.

Figure 11:
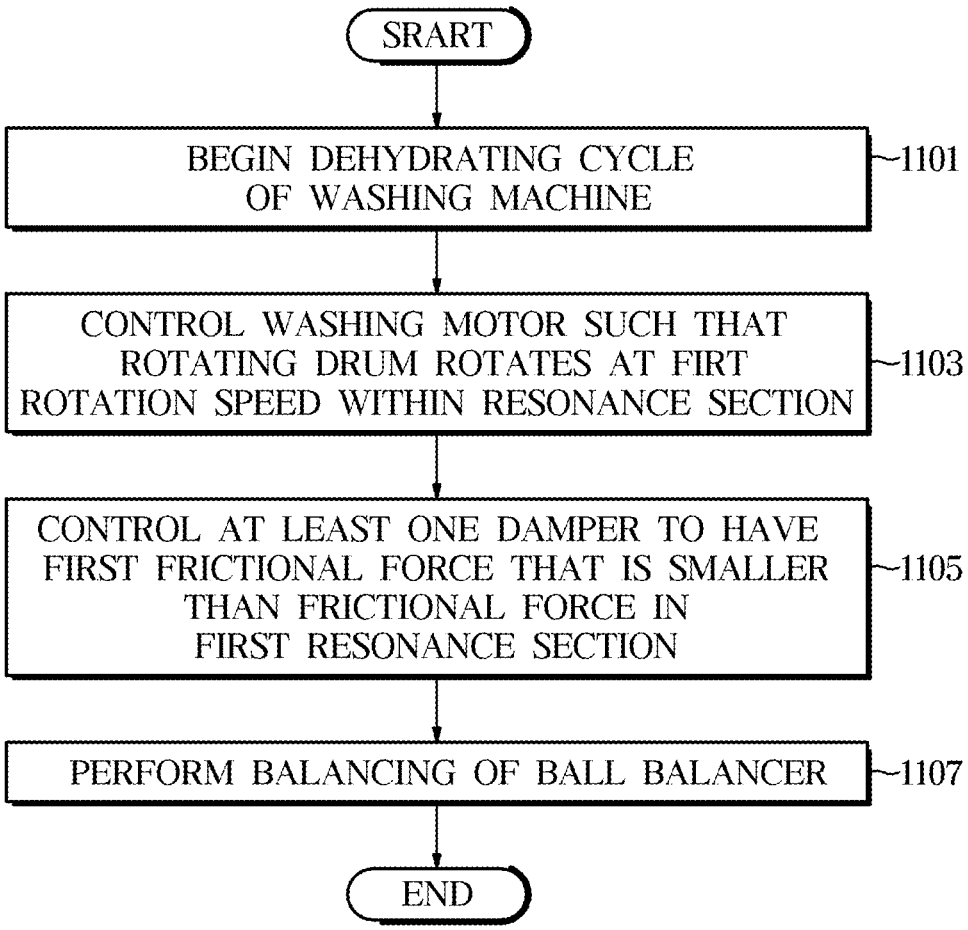
FIG. 11 is a flowchart showing a control method of a washing machine according to an embodiment.

FIG. 11 is a flowchart showing a control method of a washing machine according to an embodiment.

When a dehydrating cycle of the washing machine 1 begins (1101), a rotation speed of the drum 12 may increase gradually.

As the rotation speed of the drum 12 increases, the rotation speed of the drum 12 may pass a resonance section which is a speed section of the motor 80 causing excessive vibration of the tub. A resonance section where rpm of the drum 12 first passes is referred to a first resonance section.

While water is removed from laundry within the first resonance section, an unbalance of the laundry may occur due to materials of the laundry, etc.

Due to the unbalance, the balls inside the ball balancer may fail to move in an opposite direction of eccentricity of the laundry, which may make vibration and noise more severe, as described above with reference to FIG. 6. To prevent this, balancing may be performed to smoothly move the balls in the opposite direction of eccentricity of the laundry.

Accordingly, after the first resonance section, by rotating the motor 80 at a higher rotation speed than a resonance point for a preset time, the drum 12 may enter a second resonance section to cause excessive vibration of the tub (1103).

In addition, to increase a whirling motion of the drum 12, a damping force of the damper 100 may be controlled.

That is, by controlling, when the drum 12 enters the second resonance section, a damping force of the damper 100 to be smaller than a damping force of the damper 100 in the first resonance section, a whirling motion of the drum 12 may increase (1105).

By controlling the rotation speed of the drum 12 and the damping force of the damper 100, a whirling motion of the drum 12 may increase, and accordingly, balancing may be performed such that the balls inside the ball balancer move smoothly in an opposite direction of eccentricity of laundry (1107).

As described above, the resonance sections are not limited to the first and second resonance sections, and three or more resonance sections may appear.

In this case, when the drum 12 enters a final resonance section, a damping force of the damper 100 may be controlled to be smaller than a damping force of the damper 100 in the previous resonance section.

So far, a process of controlling a rotation speed of the motor 80 and a damping force of the damper 100 to reduce vibration and noise of the washing machine 1 has been described.

Hereinafter, a structure of the damper 100 for reducing a manufacturing time and manufacturing cost of the damper 100 will be described in detail.

Figure 12:
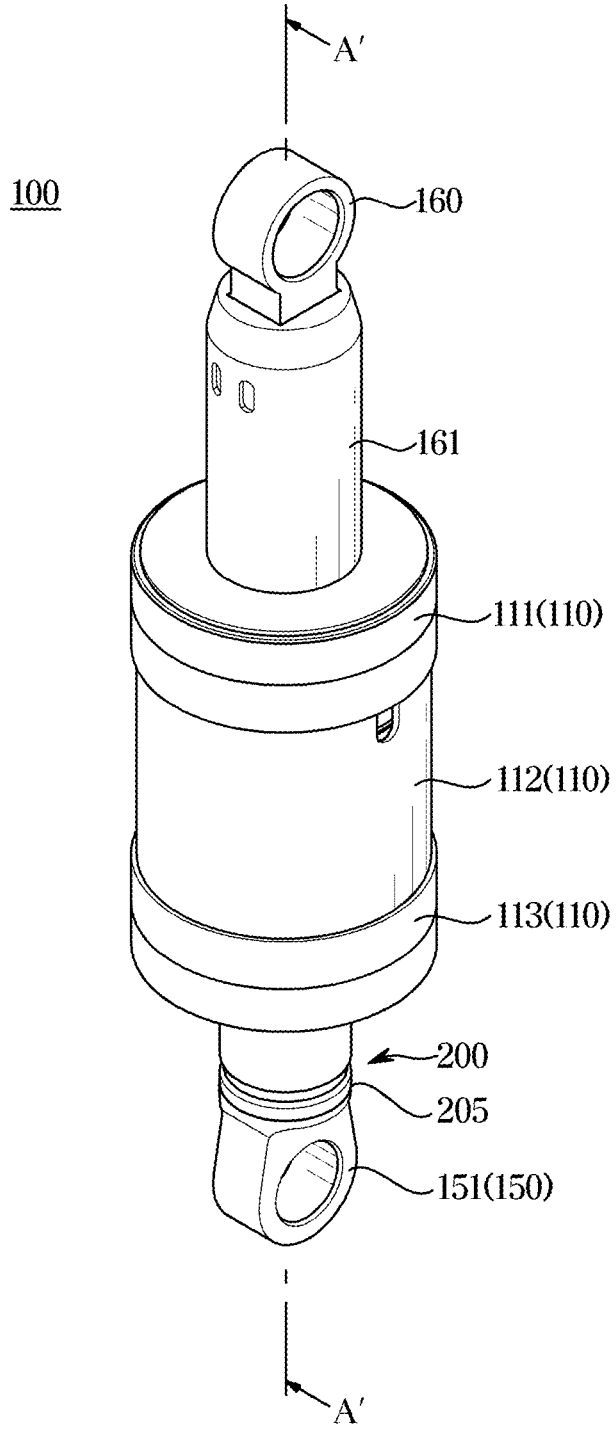
FIG. 12 is a perspective view of a damper in the washing machine shown in FIG. 2 according to an embodiment of the present disclosure.
Figure 13:
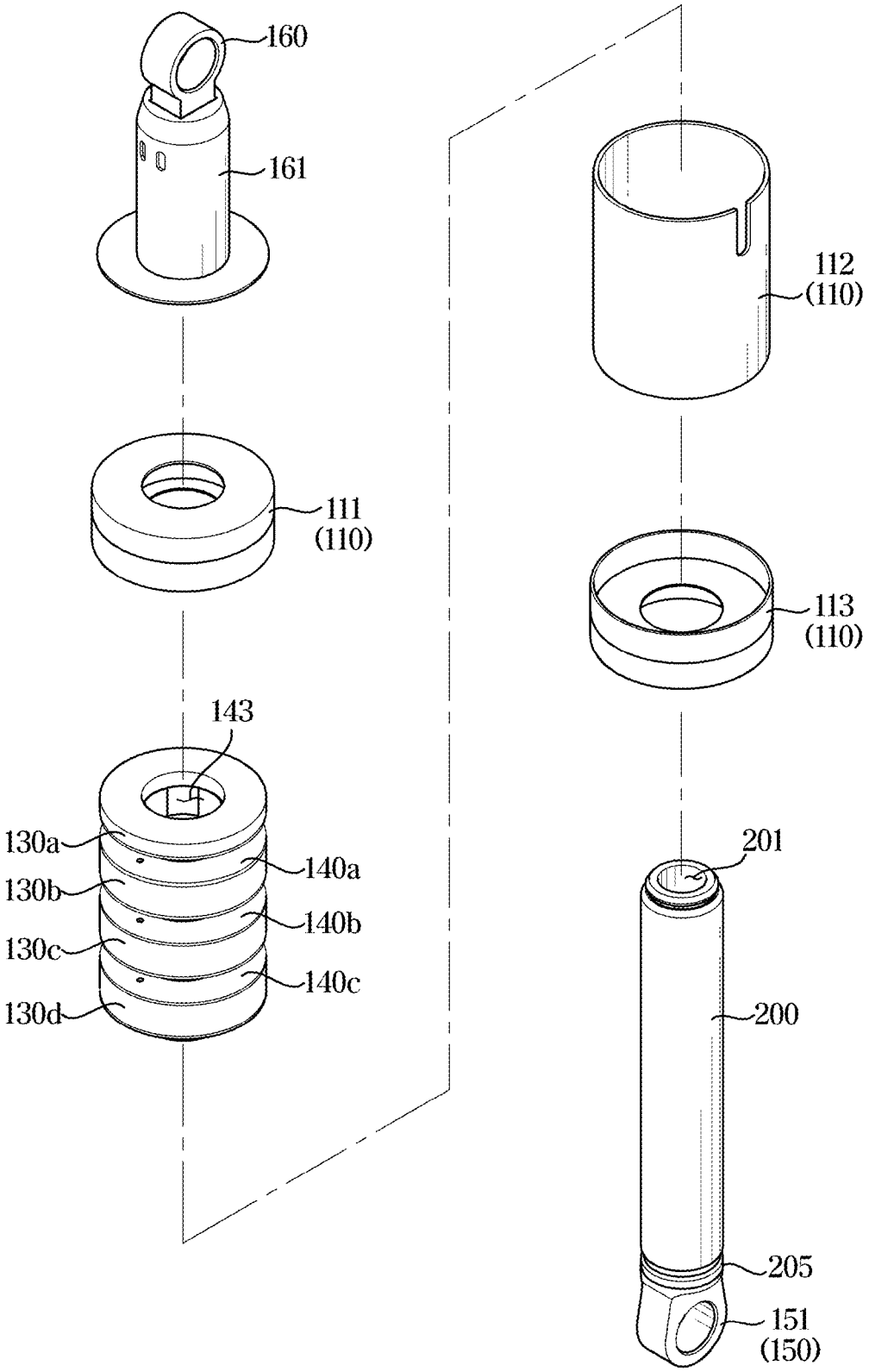
FIG. 13 is an exploded perspective view of the damper shown in FIG. 12 according to an embodiment of the present disclosure.
Figure 14:
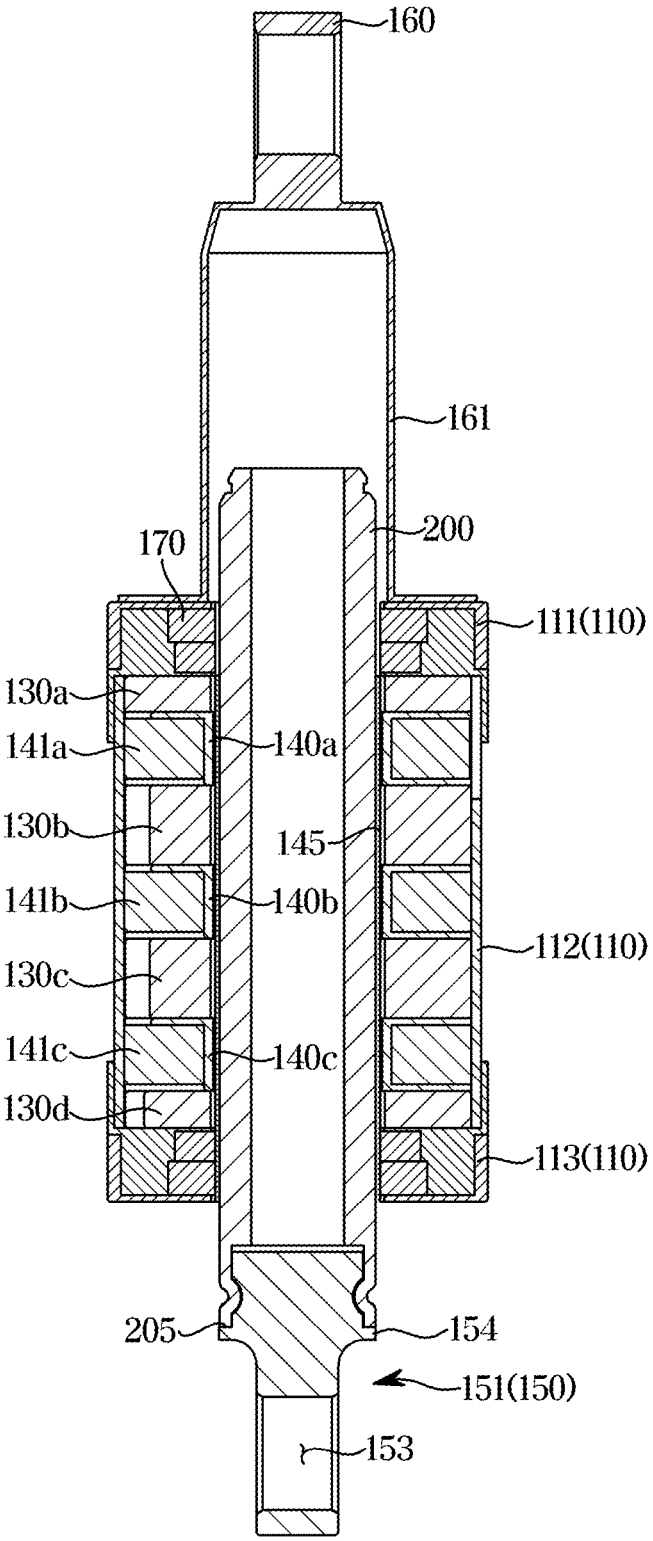
FIG. 14 is a cross-sectional view of the damper shown in FIG. 12 according to an embodiment of the present disclosure.

FIG. 12 is a perspective view of a damper in the washing machine shown in FIG. 2. FIG. 13 is an exploded perspective view of the damper shown in FIG. 12. FIG. 14 is a cross-sectional view of the damper shown in FIG. 12.

Referring to FIG. 12, the damper 100 may include a housing 110. The housing 10 may accommodate a piston 200. The housing 110 may have a substantially cylindrical shape. The housing 110 may include a hole in which the piston 200 is inserted.

The housing 110 may include an upper cap 111, a lower cap 113, and a guide ring 112. The guide ring 112 may be positioned between the upper cap 111 and the lower cap 113.

The damper 1000 may include the piston 200. The piston 200 may have a substantially cylindrical shape.

The piston 200 may be movable inside the housing 110. The piston 200 may be movable linearly inside the housing 110. In this case, due to friction between the piston 200 and the housing 110, vibration transferred from the tub 11 to the cabinet 10 may attenuate.

The damper 100 may include an upper case 161. The upper case 161 may be positioned above the housing 110. The upper case 161 may be positioned at a side of the housing 110 toward the tub 11. The second fixing portion 160 may be formed at an end of the upper case 161.

The first fixing portion 150 may be provided at an end of the piston 200. The first fixing portion 150 may be fixed to the bottom plate 10*d*, although not limited thereto. However, the first fixing portion 150 may be fixed to the tub 11, and in this case, the second fixing portion 160 may be fixed to the bottom plate 10*d*.

The first fixing portion 150 may include a header 151. The header 151 may be coupled to an end 205 of the piston 200.

Referring to FIGS. 13 and 14, the damper 100 may include a magnetic field generator. The magnetic field generator may include a yoke 130 and a bobbin 140.

The yoke 130 may surround an outer circumferential surface of the piston 200 inside the housing 110. The yoke 130 may include a through hole 143 in which the piston 200 is inserted. The yoke 130 may include a magnetic material. A plurality of yokes 130 may be provided. The yokes 130 may include a first yoke 130*a* and a second yoke 130*b* spaced from the first yok 130*a* along the extension direction of the housing 110.

The damper 100 may include the bobbin 140. The bobbin 140 may surround the outer circumferential surface of the piston 200 inside the housing 110. The bobbin 140 may include a through hole 143 in which the piston 200 is inserted. A coil 141 may be wound around the bobbin 140. The bobbin 140 may include a non-magnetic material.

A plurality of bobbins 140 may be provided. The bobbins 140 may include a first bobbin 140*a* and a second bobbin 140*b* spaced from the first bobbin 140*a* along the extension direction of the housing 110. Each of the plurality of bobbins 140 may be positioned between the plurality of yokes 130 to space the plurality of yokes 130 apart from each other. For example, the first bobbin 140*a* may be positioned between the first yoke 130*a* and the second yoke 130*b*, and the second bobbin 140*b* may be positioned between the second yoke 130*b* and a third yoke 130*c*. The plurality of bobbins 140 may be spaced from each other along the extension direction of the housing 110.

The yoke 130 and the bobbin 140 may be arranged along the extension direction of the housing 110.

Referring to FIG. 14, the damper 100 may include a friction member 145.

The friction member 145 may surround the outer circumferential surface of the piston 200. The friction member 145 may be positioned between the piston 200 and the yoke 130. The friction member 145 may be positioned inside the through hole 143 of the yoke 130. The friction member 145 may be positioned between an inner surface of the yoke 130 forming the through hole 143 and an outer surface of the piston 200.

The friction member 145 may be positioned between the piston 200 and the bobbin 140. The friction member 145 may be positioned inside the through hole 143 of the bobbin 140. The friction member 145 may be positioned between an inner surface of the bobbin 140 in which the through hole 143 is formed and the outer surface of the piston 200. That is, the friction member 145 may surround the piston 200 inside the through holes 143 of the yoke 130 and/or the bobbin 140.

The piston 200 may be positioned in a center of the damper 100, the friction member 145 may be positioned outward along a radial direction, and the yoke 130 and/or the bobbin 140 may be positioned outside the friction member 145.

The friction member 145 may include a Magneto-Rheological Fluid. While current flows through the coil 141 wound around the bobbin 140, a magnetic field may be formed by the yoke 130, and viscosity of the magnetorheological fluid may change by the magnetic field. For example, while the drum 12 rotates at a low speed, viscosity of the magneto-rheological fluid may increase by applying current to the coil 141. At this time, a frictional force applied to the friction member 145 may increase according to a movement of the piston 200, and thus, a damping force of the damper 100 may increase. In contrast, while the drum 12 rotates at a high speed, viscosity of the magneto-rheological fluid may decrease by applying no current to the coil 141, and, at this time, a frictional force applied to the friction member 145 may decrease according to a movement of the piston 200, and thus, a damping force of the damper 100 may be lowered.

In the drawings, the damper 100 using magnetic field generators 130 and 140 and the magneto-rheological fluid 145 is shown as an example. However, the disclosure is not limited thereto. That is, as long as the damper 100 is capable of attenuating vibration of the washing machine 1 by a motion of the piston 200, the damper 100 may omit the magnetic field generators 130 and 140 and/or the friction member 145, or may be implemented as another structure.

Figure 15:
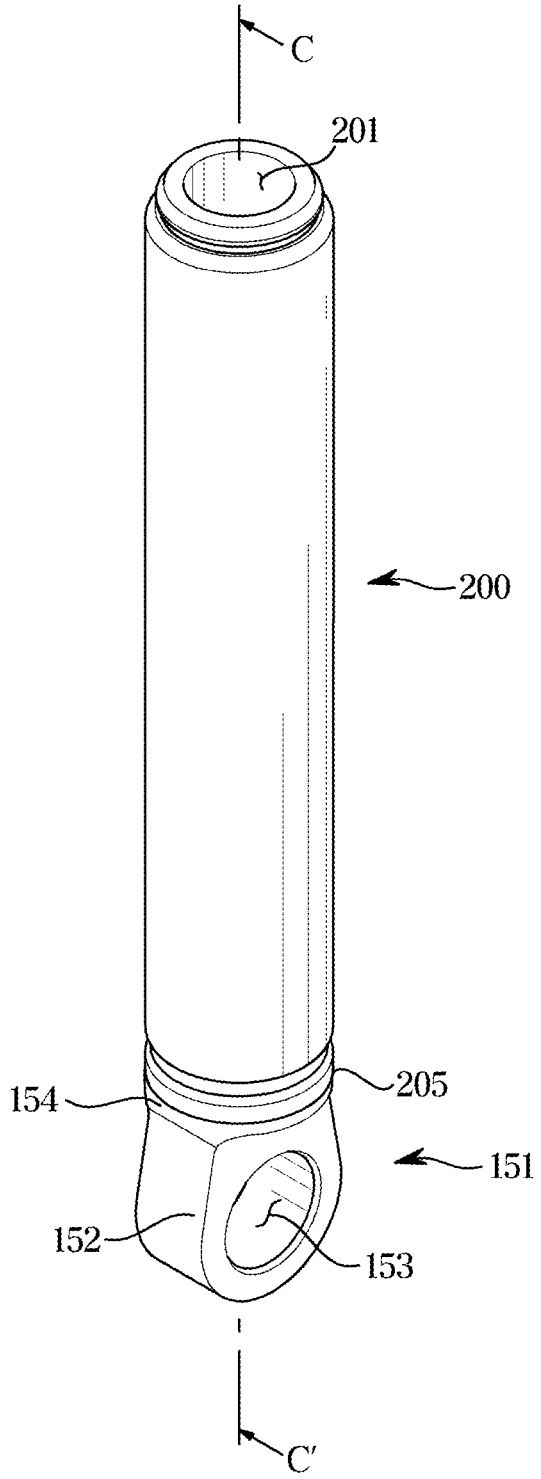
FIG. 15 is a perspective view showing an embodiment of a piston and a header which are components of the damper shown in FIG. 12.
Figure 16:
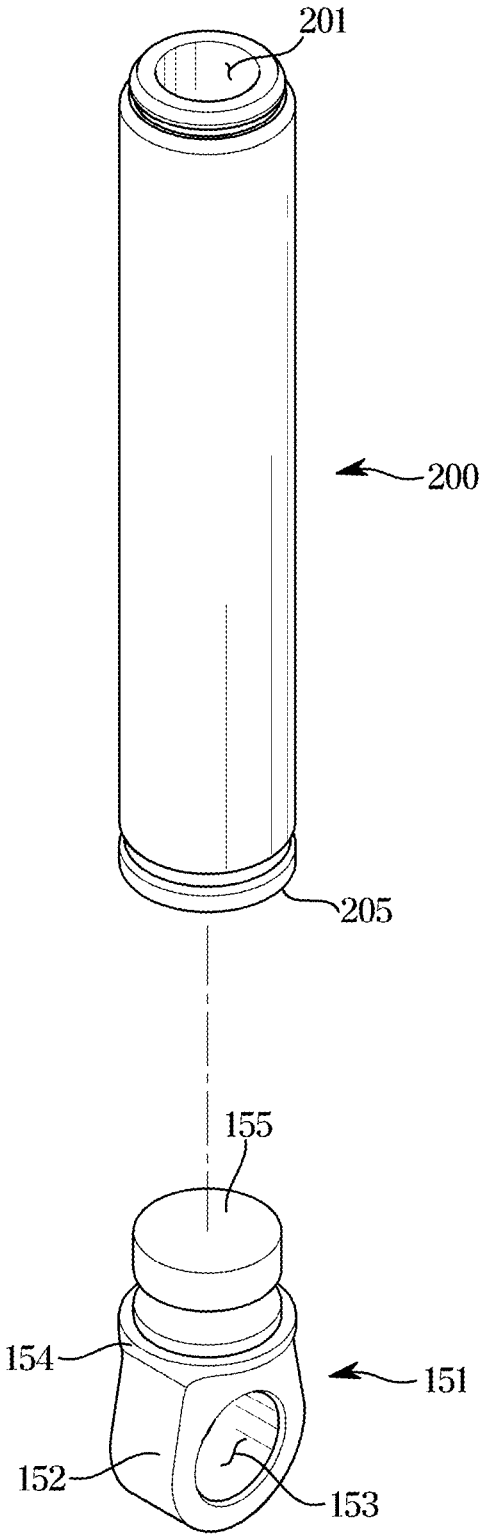
FIG. 16 is an exploded perspective view of the piston and the header of FIG. 15 according to an embodiment of the present disclosure.

FIG. 15 is a perspective view showing an embodiment of a piston and a header which are components of the damper shown in FIG. 12. FIG. 16 is an exploded perspective view of the piston and the header of FIG. 15.

The piston 200 may include a hollow 201. The hollow 201 may be provided inside the piston 200. The hollow 201 may extend along the extension direction of the housing 110. The hollow 201 may extend along an extension direction of the piston 200.

The hollow 201 may extend from the end 205 of the piston 200 to another end. The hollow 201 may have a substantially cylindrical shape.

The piston 200 may have a substantially cylindrical shape. A cross-section of the piston 200 in a direction that is orthogonal to the extension direction of the piston 200 may have a circular shape.

The header 151 may be coupled to the piston 200. The header 151 may include an inserting portion 155 coupled to the hollow 201 of the piston 200, a body portion 152 coupled to the first damper coupling portion 10*e*, and a connecting portion 153 connecting the inserting portion 155 to the body portion 152. The body portion 152 of the header 151 may include a header hole 153.

The inserting portion 155 of the header 151 may be inserted into an inlet 202 of the hollow 201 of the piston 200 and coupled to the piston 200. The inserting portion 155 may protrude toward the piston 200.

Figure 17:
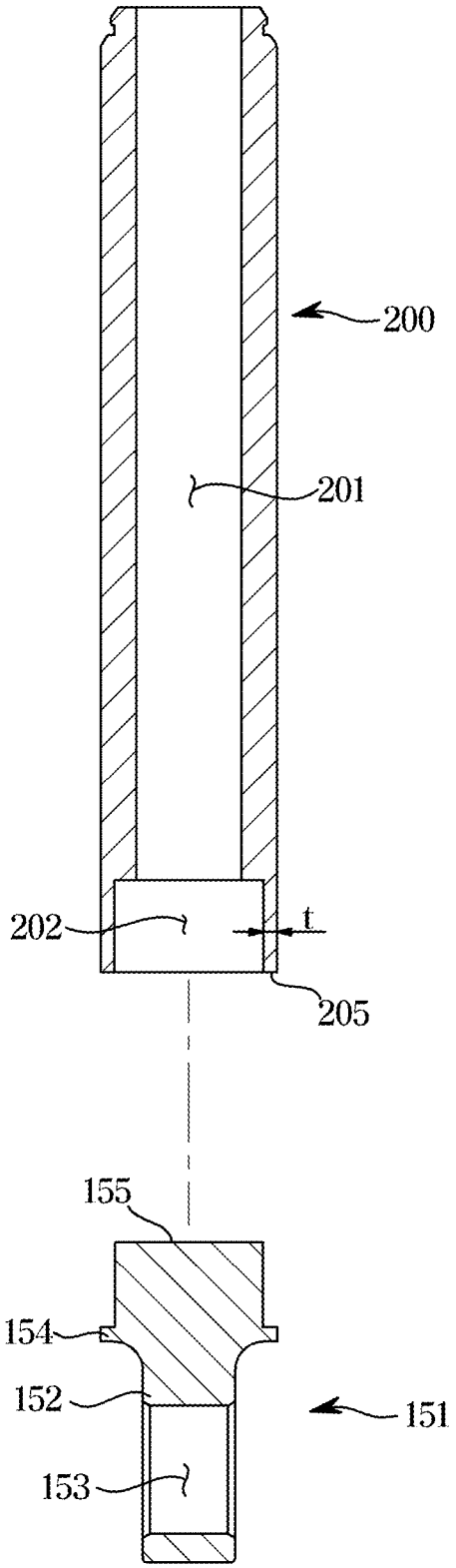
FIG. 17 is a cross-sectional view showing a process of coupling the piston and the header of FIG. 15 according to an embodiment of the present disclosure.
Figure 18:
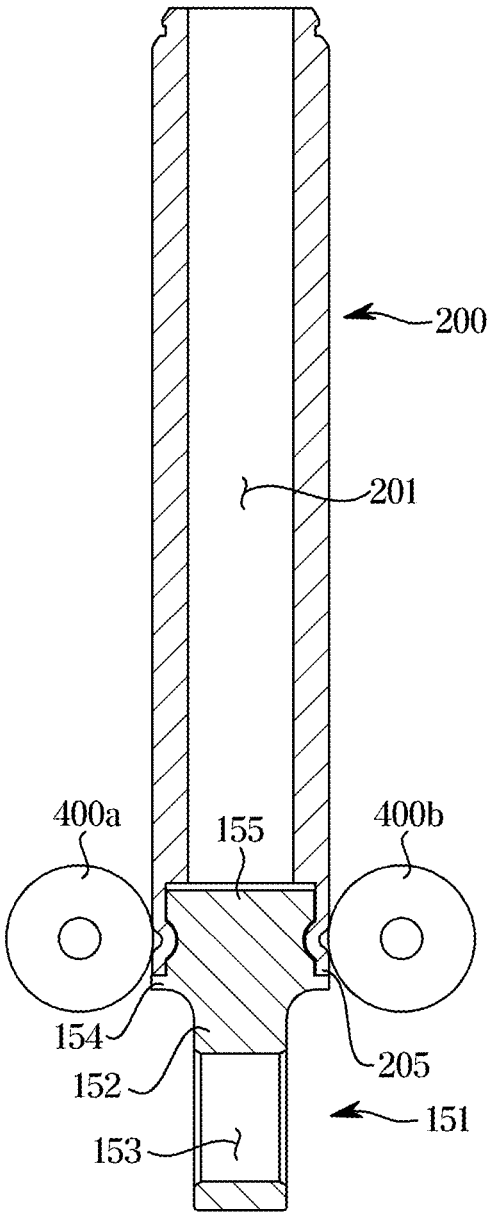
FIG. 18 is a cross-sectional view showing a coupled state of the piston and the header of FIG. 15 according to an embodiment of the present disclosure.
Figure 19:
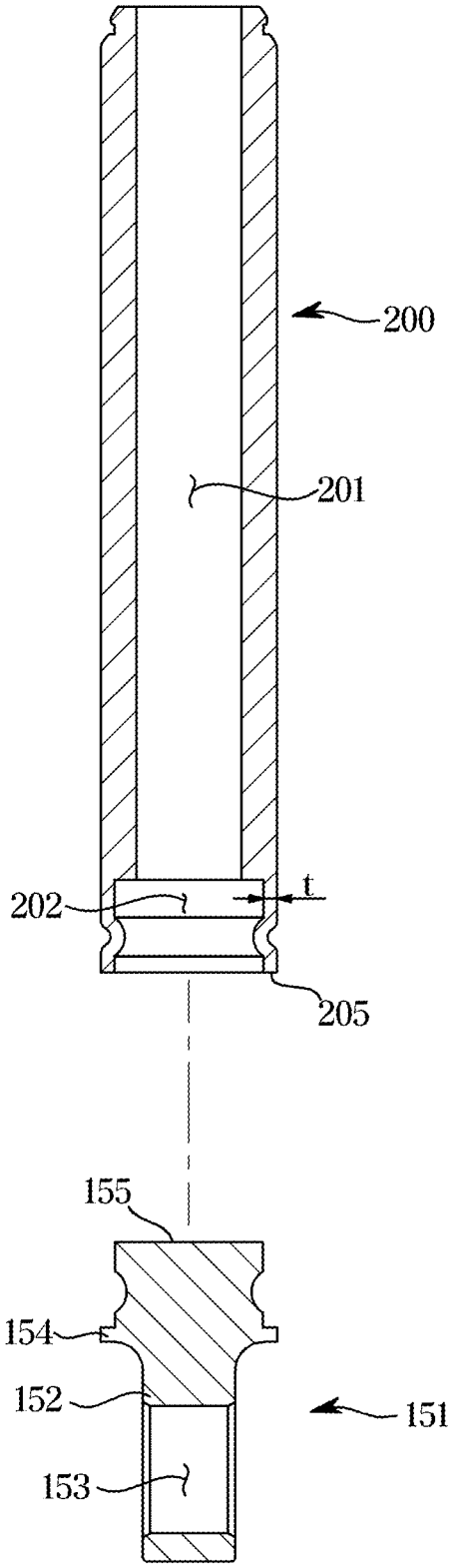
FIG. 19 is an exploded cross-sectional view of the piston and the header of FIG. 18 according to an embodiment of the present disclosure.

FIG. 17 is a cross-sectional view showing a process of coupling the piston and the header of FIG. 15. FIG. 18 is a cross-sectional view showing a coupled state of the piston and the header of FIG. 15. FIG. 19 is an exploded cross-sectional view of the piston and the header of FIG. 18.

The piston 200 may be formed by a drawing process. More specifically, the piston 200 may be manufactured by drawing a steel material, and the hollow 201 may be formed inside the piston 200.

According to the present disclosure, by manufacturing the piston 200 of the damper 100 by a drawing process, a manufacturing time may be reduced and manufacturing cost may be saved. Also, because the piston 200 includes the hollow 201, a weight of the damper 100 may be reduced.

The hollow 201 may include the inlet 202. The inlet 202 may be provided in the end 205 of the piston 200. The header 202 may be assembled into the inlet 202.

Referring to FIG. 17, an outer circumferential surface of the inlet 202 may be processed such that the header 151 is inserted in the hollow 201 of the piston 200. More specifically, a cutting process may be performed on the hollow 201 such that a thickness t of the inlet 202 is formed to be about 2 mm or less. A circumference of the cut inlet 202 may correspond to a circumference of the inserting portion 155 of the header 151. The inlet 202 may be cut to correspond to a shape of the inserting portion 155.

Thereafter, referring to FIG. 18, the header 151 may be inserted into the cut inlet 202. Then, a rolling process may be performed on the piston 200 and the header 151 through a rolling mill (not shown).

More specifically, the rolling mill (not shown) may include a roller 400. The roller 400 may include a pair of rollers 400*a* and 400*b*. The piston 200 in which the header 151 is inserted may pass between the pair of rollers 400*a* and 400*b*, and the pair of rollers 400*a* and 400*b* may form the inlet 202 of the piston 200 and the inserting portion 155 of the header 151 by pressing the piston 200 in which the header 151 is inserted.

As described above, because the thickness t of the inlet 202 of the piston 200 has been reduced through the cutting process, the inlet 202 of the piston 200 may be easily formed by the rolling mill (not shown). Accordingly, the inlet 202 and the inserting portion 155 may have curved shapes.

Also, the rolling mill (not shown) may couple the header 151 to the piston 200 through hot rolling which is processed at a high temperature. More specifically, the pair of rollers 400*a* and 400*b* heated to a high temperature may fix the header 151 to the piston 200 by pressing the piston 200 and the header 151.

In this case, a separate tightening operation or bonding process for coupling the piston 200 with the header 151 may be unnecessary. Therefore, it may be advantageous in view of manufacturing time and manufacturing cost. In addition, firm coupling may be possible without worrying about loosening.

Figure 20:
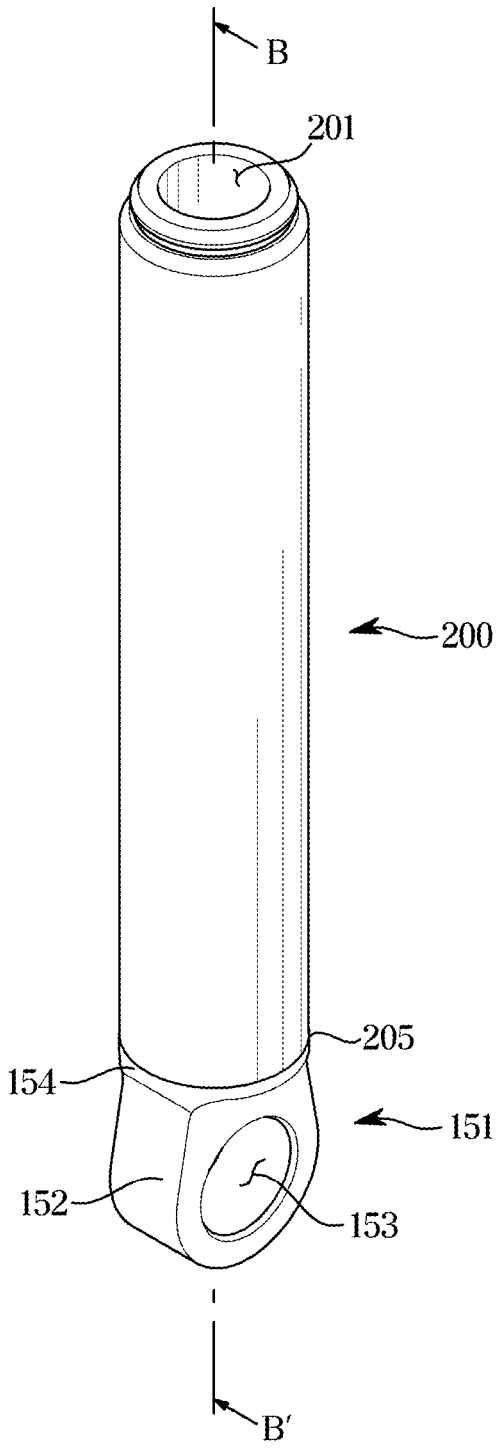
FIG. 20 is a perspective view showing another embodiment of a piston and a header which are components of the damper shown in FIG. 12.
Figure 21:
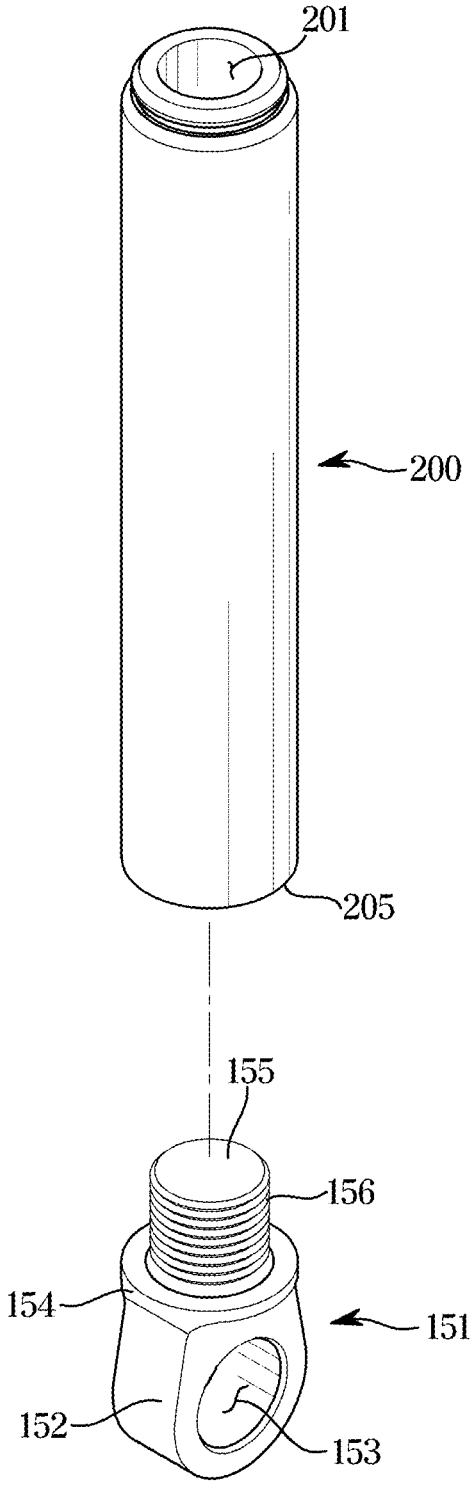
FIG. 21 is an exploded perspective view of the piston and the header of FIG. 20 according to an embodiment of the present disclosure.
Figure 22:
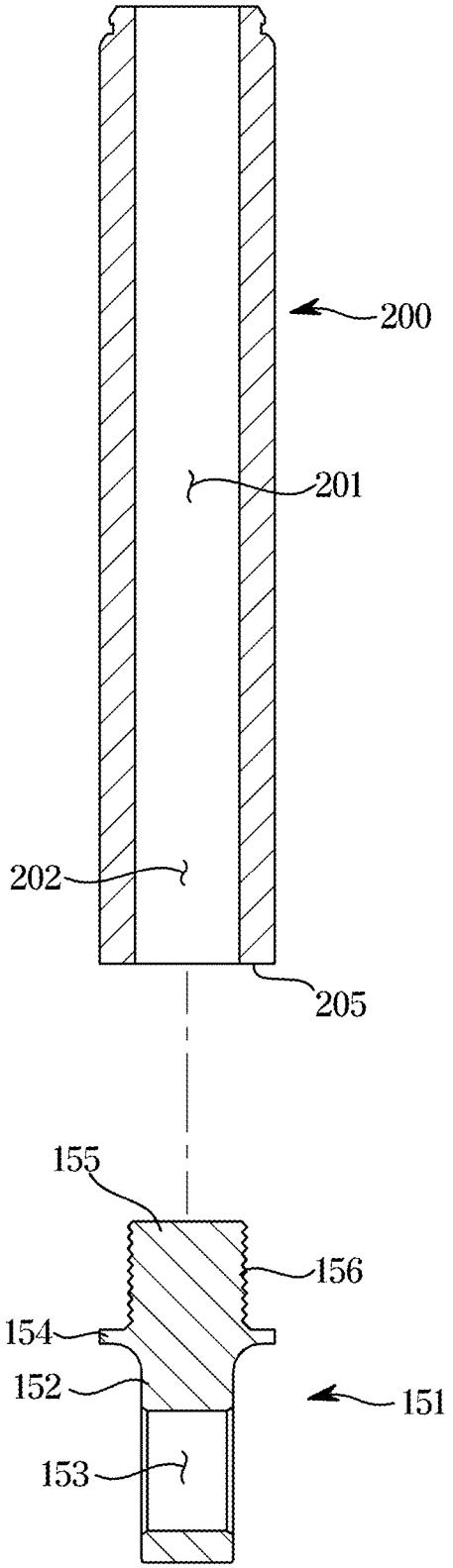
FIG. 22 is a cross-sectional view showing a process of coupling the piston and the header of FIG. 20 according to an embodiment of the present disclosure.
Figure 23:
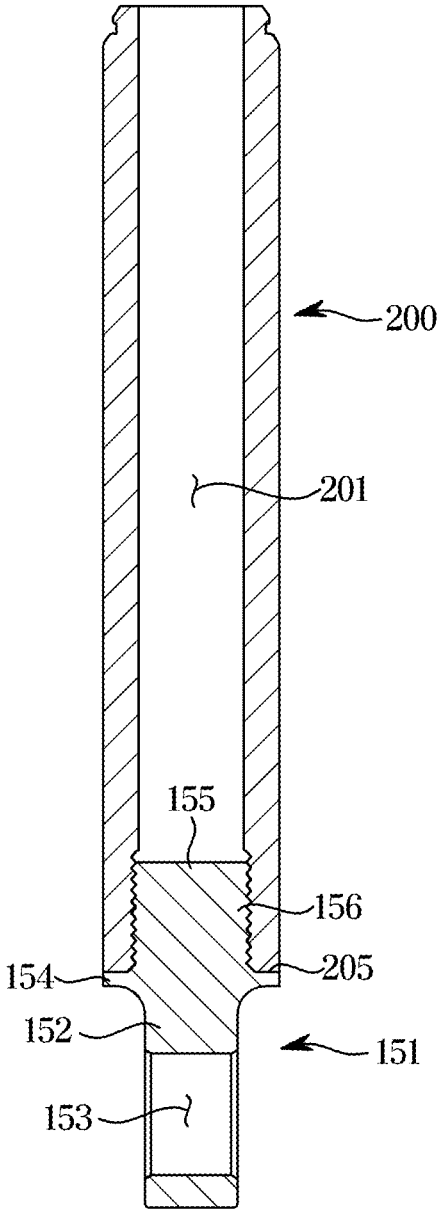
FIG. 23 is a cross-sectional view showing a coupled state of the piston and the header of FIG. 20 according to an embodiment of the present disclosure.
Figure 24:
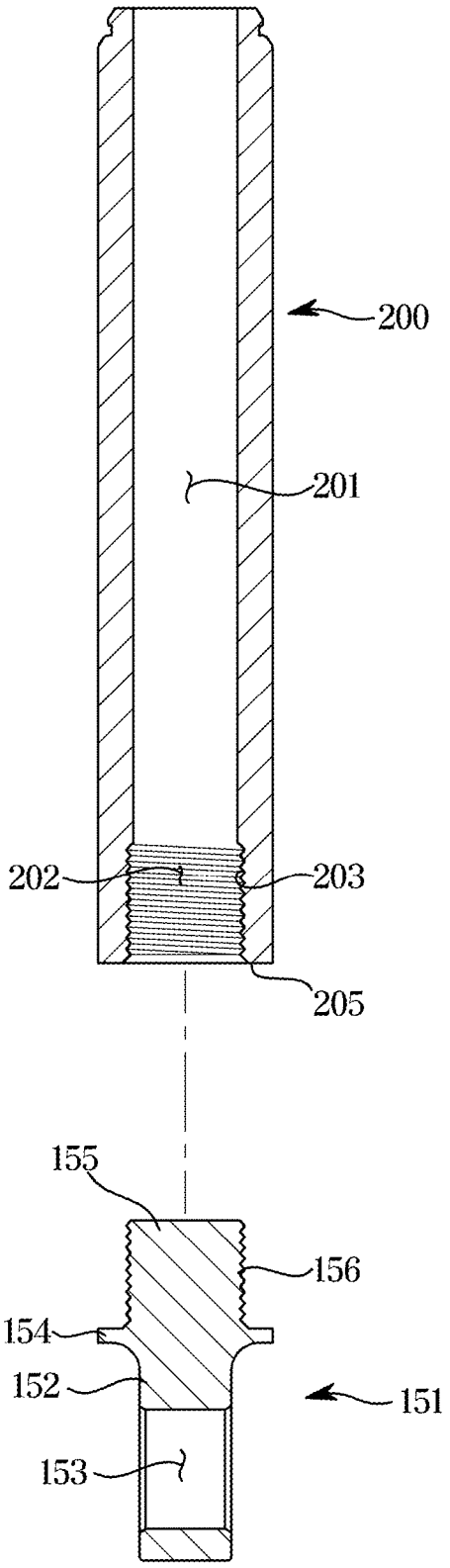
FIG. 24 is an exploded cross-sectional view of the piston and the header of FIG. 23 according to an embodiment of the present disclosure.

FIG. 20 is a perspective view showing another embodiment of a piston and a header which are components of the damper shown in FIG. 12. FIG. 21 is an exploded perspective view of the piston and the header of FIG. 20. FIG. 22 is a cross-sectional view showing a process of coupling the piston and the header of FIG. 20. FIG. 23 is a cross-sectional view showing a coupled state of the piston and the header of FIG. 20. FIG. 24 is an exploded cross-sectional view of the piston and the header of FIG. 23.

The piston 200 may include the hollow 201. The header 151 may be coupled to the piston 200. Hereinafter, descriptions overlapping with those of FIGS. 15 to 19 will be omitted.

The inserting portion 155 of the header 155 may include a screw portion 156. Referring to FIG. 22, the header 151 may be inserted into the inlet 202 of the piston 200. At this time, the inserting portion 155 of the header 151 may be inserted into the hollow 201 of the piston 200 by rotating.

More specifically, the screw portion 156 of the inserting portion 155 may be a tapping-screw, wherein the tapping-screw itself cuts a coupling target. Accordingly, by inserting the screw portion 156 into the hollow 201 of the piston 200 as a coupling target and rotating the screw portion 156, a screw groove portion 203 may be formed in the inlet 202 of the hollow 201.

The screw groove portion 203 may be formed to correspond to threads of the screw portion 156. Accordingly, the screw portion 156 of the header 151 may be engaged with the screw groove portion 203 of the piston 200 to couple the header 151 to the piston 200.

Hereinafter, an additional bonding process may be performed to more firmly couple the header 151 to the piston 200.

According to the disclosure, by rotating, while a dehydrating cycle is performed, the drum in a resonance section and reducing a frictional force of the damper to increase a whirling motion of the drum such that the balls of the ball balancer are positioned in an opposite side of weight eccentricity of laundry, vibration and noise of the washing machine may be reduced.

Meanwhile, the disclosed embodiments may be implemented in the form of recording medium that stores instructions executable by a computer. The instructions may be stored in the form of program codes, and when executed by the processor, the instructions may generate a program module to perform the operations of the disclosed embodiments. The recording medium may be implemented as computer-readable recording medium.

The computer-readable recording medium includes all kinds of recording media storing instructions that can be decrypted by a computer. For example, the computer-readable recording medium may be Read Only Memory (ROM), Random Access Memory (RAM), a magnetic tape, a magnetic disk, flash memory, or an optical data storage device.

So far, the disclosed embodiments have been described with reference to the accompanying drawings. It will be apparent that those of ordinary skill in the technical field to which the present disclosure belongs can make various modifications thereto without changing the technical spirit and essential features of the present disclosure. Thus, it should be understood that the disclosed embodiments are merely for illustrative purposes and not for limitation purposes.

The invention claimed is:

1. A washing machine comprising:
- a cabinet;
- a tub arrangeable inside the cabinet;
- a drum rotatable inside the tub;
- a motor configured to generate power to rotate the drum;
- a ball balancer arrangeable in the drum;
- a damper, to support the tub, configured to have a damper force that is changeable; and
- at least one processor configured to control a rotation speed of the motor and control the damper force of the damper,
- wherein as the drum is rotated by the motor according to the rotation speed of the motor controlled by the at least one processor, the at least one processor is configured to perform balancing of the ball balancer by controlling the damper force of the damper such that a damper force in a final resonance section among a plurality of resonance sections that occur is smaller than a damper force in a previous resonance section among the plurality of resonance sections.

2. The washing machine of claim 1, wherein the at least one processor is configured to:
- increase the rotation speed of the motor such that the drum passes the previous resonance section,
- control the motor to rotate at a second rotation speed that is higher than a first rotation speed in the previous resonance section for a preset time, and
- decrease the rotation speed of the motor according to elapse of the preset time such that the drum passes the final resonance section.

3. The washing machine of claim 1, wherein the at least one processor is configured to perform the balancing of the ball balancer based on a position and a weight of laundry.

4. The washing machine of claim 3, wherein the at least one processor is configured to perform the balancing such that balls inside the ball balancer move in an opposite side of eccentricity according to the position and the weight of the laundry.

5. The washing machine of claim 1, wherein the at least one processor is configured to perform a dehydrating cycle by driving the motor at a maximum rotation speed after the balancing of the ball balancer.

6. The washing machine of claim 1, wherein a resonance section is a speed section of the motor in which excessive vibration of the tub occurs during a dehydrating cycle.

7. The washing machine of claim 1, wherein the ball balancer is arranged in at least one of a front side or a rear side of the drum.

8. The washing machine of claim 1, wherein
- the damper comprises:
  - a housing extending between the cabinet and the tub;
  - a piston configured to move inside the housing, the piston including an inside that is hollow that extends along an extension direction of the housing; and
  - a header coupled to an end of the piston.

9. The washing machine of claim 8, wherein
- the piston is formed to include the hollow by drawing a steel material,
- the hollow includes an inlet cut to correspond to a shape of the header such that the header is insertable in the inlet, and
- the header while inserted in the inlet is pressed by a roller and fixed to the piston.

10. The washing machine of claim 8, wherein
- the piston is formed to include the hollow by drawing a steel material,
- the header includes a screw portion insertable in the hollow, and
- the hollow includes a screw groove portion formed by rotating the screw portion and corresponding to the screw portion.

11. The washing machine of claim 8, further comprising:
- a bobbin surrounding an outer circumferential surface of the piston inside the housing, a coil being wound around the bobbin;
- a yoke, arrangeable along the extension direction of the housing with respect to the bobbin, configured to form a magnetic field while current flows through the coil wound around the bobbin; and
- a friction member, arrangeable between the piston and the yoke, including a Magneto-Rheological Fluid of which viscosity changes by a magnetic field.

12. A control method of a washing machine including a cabinet, a tub arrangeable inside the cabinet, the control method comprising:
- rotating a motor configured to rotate a drum rotatable inside the tub of the washing machine such that a plurality of resonance sections occur; and
- performing balancing of a ball balancer by controlling a damper force of a damper such that a damper force in a final resonance section among a plurality of resonance sections that occur is smaller than a damper force in a previous resonance section among the plurality of resonance sections.

13. The control method of claim 12, wherein the rotating of the motor comprises:
- gradually increasing a rotation speed of the motor such that the drum passes the previous resonance section;

controlling the motor to rotate at a second rotation speed that is higher than a first rotation speed in the previous resonance section, for a preset time; and decreasing a rotation speed of the motor according to elapse of the preset time such that the drum passes the final resonance section.

14. The control method of claim 12, wherein the performing of the balancing comprises performing balancing of the ball balancer based on a position and weight of laundry.

15. The control method of claim 14, wherein the performing of the balancing comprises performing balancing such that balls inside the ball balancer move to an opposite side of eccentricity according to the position and weight of the laundry.

* * * * *